US006564929B2

(12) United States Patent
Reisacher

(10) Patent No.: US 6,564,929 B2
(45) Date of Patent: May 20, 2003

(54) APPARATUS AND METHOD FOR POSITIONING, HANDLING AND CONVEYING STRUCTURAL PARTS

(76) Inventor: Raimund Reisacher, Römerweg 21a D-67117, Limburgerhof (DE)

( * ) Notice: Subject to any disclaimer, the term of this patent is extended or adjusted under 35 U.S.C. 154(b) by 0 days.

(21) Appl. No.: 09/742,615

(22) Filed: Dec. 21, 2000

(65) Prior Publication Data

US 2001/0009216 A1 Jul. 26, 2001

(30) Foreign Application Priority Data

| | | |
|---|---|---|
| Jan. 26, 2000 | (DE) | 200 01 326 |
| Feb. 26, 2000 | (DE) | 200 03 609 |
| Aug. 10, 2000 | (DE) | 200 14 015 |

(51) Int. Cl.[7] ..... B65G 17/32

(52) U.S. Cl. ..... 198/687.1; 118/500; 134/133; 204/297.16

(58) Field of Search ..... 198/465.4, 682.1, 198/867.1, 803.13, 486.1, 484.1; 118/500, 502; 134/133, 142, 165; 204/297.06, 297.16

(56) References Cited

U.S. PATENT DOCUMENTS

| | | | | | |
|---|---|---|---|---|---|
| 2,196,663 | A | * | 4/1940 | Isele | 118/502 |
| 2,322,299 | A | * | 6/1943 | Kouyoumjian | 198/484.1 |
| 2,609,083 | A | * | 9/1952 | Leach | 198/465.4 |
| 4,279,201 | A | * | 7/1981 | Solomon | 198/465.4 |

FOREIGN PATENT DOCUMENTS

| | | |
|---|---|---|
| DE | 42 43 252 | 7/1993 |
| DE | 195 37 664 | 4/1997 |
| DE | 198 48 671 | 4/1999 |
| FR | 2 675 483 | 4/1991 |

* cited by examiner

*Primary Examiner*—Joseph E. Valenza
(74) *Attorney, Agent, or Firm*—Collard & Roe, P.C.

(57) ABSTRACT

An apparatus for positioning, handling and conveying structural parts for a surface finishing of the parts comprises frames arranged successively in a conveying direction, hooks carried by the frames for hanging the structural parts, and devices for maintaining successive ones of the frames in the conveying direction so close to each other that the structural parts hanging on the hooks are locked in position by the successive frames.

28 Claims, 18 Drawing Sheets

A
A
1
6
7
8
9
10
11
14
16
17
38
4,5
Lt
Rh
Bb
Lb 6
9
11
2,3
4,5
8
14
29
36

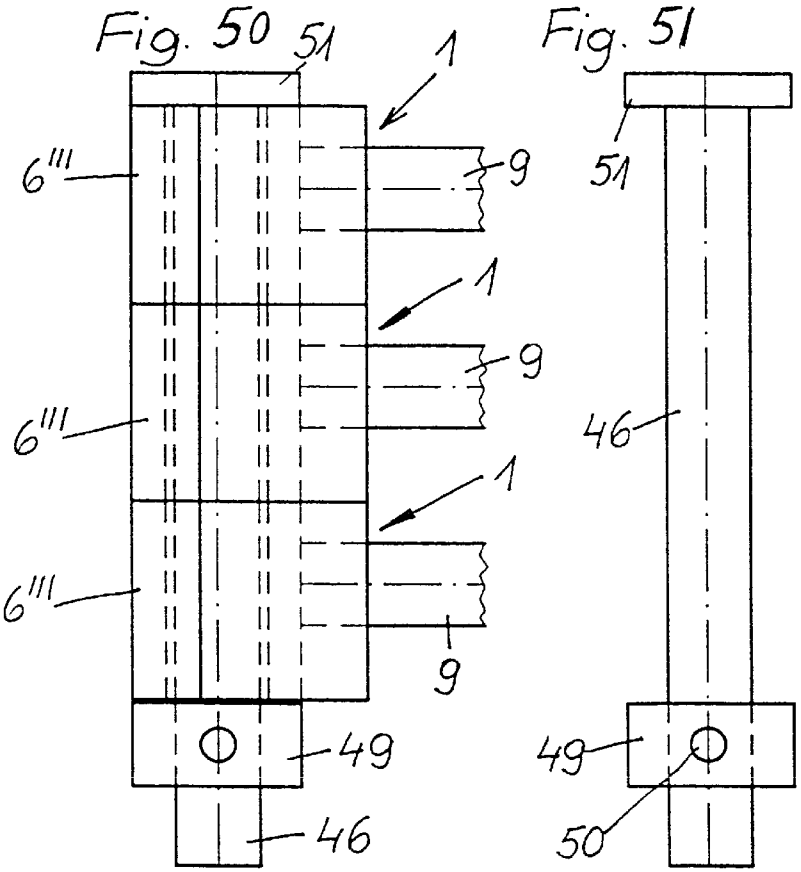
Fig. 51
Fig. 50
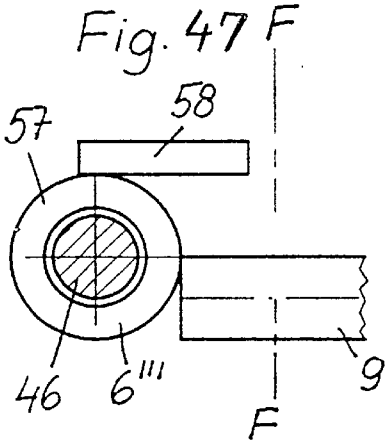
Fig. 47
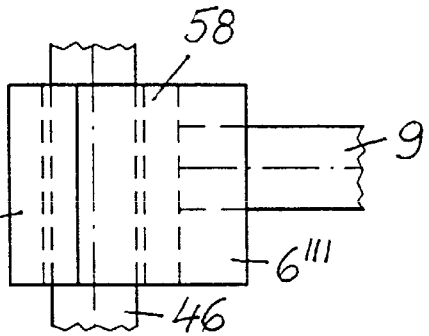
Fig. 49
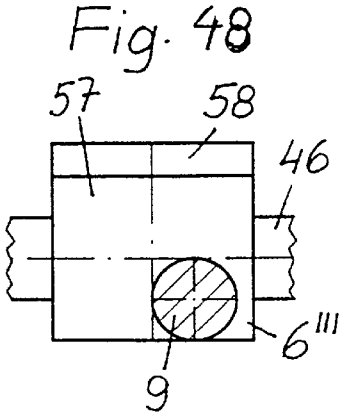
Fig. 48

H
H
1
61
63'
64
65
66
9
7
4,5
8
6'
52
59
62

APPARATUS AND METHOD FOR POSITIONING, HANDLING AND CONVEYING STRUCTURAL PARTS

BACKGROUND OF THE INVENTION

1. Field of the Invention

The present invention relates to an apparatus and a method for positioning, handling and conveying structural parts in a conveying direction for surface finishing the structural parts hanging on frames, for example in an immersion bath for hot galvanizing, lacquering or powder coating.

2. Description of the Prior Art

In the surface finishing of various structural parts, such as rods or flat elements, the parts are conveyed loosely, on pallets or in carrying frames. The structural parts must then be hung, usually by hand, on suitable apparatus for the surface finishing treatment. For technical reasons, the hanging is usually effected overhead and/or in close quarters. Typical apparatus for hanging the structural parts are hook systems on conveyor chains, or hook or wire fastenings on crossheads or special frames. Automatic handling during surface finishing is usually too expensive and requires such high specialization that it can be amortized only in mass production operations. Sometimes, a number of different surface finishing treatments are needed, which requires additional grouping and re-hanging of the structural parts. After the surface finishing treatment, the finished parts must be manually removed, usually overhead, and be readied for delivery.

SUMMARY OF THE INVENTION

It is the primary object of this invention to provide a system which enables the structural parts to be charged to the system and removed therefrom with simple means, either manually or automatically, horizontally or vertically, while the structural parts are locked in position during treatment.

The above and other objects are accomplished according to one aspect of the invention with an apparatus which comprises successively arranged frames, each frame comprising two lateral blocks, two lateral braces, a transverse shaft connecting free ends of the lateral braces remote from the lateral blocks, and hooks for hanging the structural parts, the hooks being affixed to the transverse shaft and spaced from each other in a transverse direction, successive ones of the frames in the conveying direction being so close to each other that the structural parts hanging on the hooks are locked in position by the transverse shafts of the successive frames.

According to another aspect, the invention provides a method for positioning, handling and conveying structural parts for a surface finishing of the parts, which comprises conveying successively arranged frames in a conveying direction, hanging the structural parts on hooks carried by the frames, and maintaining successive ones of the frames in the conveying direction so close to each other that the structural parts hanging on the hooks are locked in position by the successive frames.

With such an apparatus or method, the structural parts may be inserted and removed during a horizontal or vertical conveyance, and the system may be sealed during transport and conveyance of the parts in a finishing bath while the parts are locked in position, to hold them securely, for example, in truck containers, during racking or galvanizing.

During galvanizing, steel parts tend to float in the galvanizing bath and to become detached from the hooks on which they are hung, which the apparatus of the present invention prevents. Furthermore, the system provides ready accessability from above for wiping the bath liquid off during hot galvanizing, the structural parts may be readily singled for quality control or for lacquering, the apparatus may be manipulated with a crane or high-lift, and it may be deposited in a number of superposed planes in pallet shelves or in containers. For transport, charging and during surface finishing in an immersion bath, the structural parts may be tightly packed and securely locked in position. Long and heavy or sensitive hung structural parts will not freely swing. It is easy to single the structural parts automatically for lacquering or powder coating so that the parts are readily accessible from the side. The surface areas and masses of the apparatus directly involved in the surface finishing process are small and may, therefore, be readily protected. The hooking system may be readily produced and may be of noble materials, such as titanium or stainless steel, so that it is well adapted to automatic cleaning. The crossheads connecting the lateral blocks of the apparatus have a substantial distance from the finishing bath level, and they may be readily loaded and removed with a crane, a high-lift or other devices. They may be simply transported by conveyor chains, the crossheads of successive frames may be conveyed closely together in the conveying direction, and they may be rotated about their longitudinal axes and about a vertical axis. The system is flexible and, depending on the hooking system, it can handle structural parts of different lengths, widths and depths. It can handle profiled parts, tubes or solid parts.

BRIEF DESCRIPTION OF THE DRAWING

The above and other objects, advantages and features of the present invention will become more apparent from the following detailed description of certain now preferred embodiments thereof, taken in conjunction with the accompanying, generally schematic drawing wherein

FIG. 47 shows a side elevationl view of yet another embodiment of the lateral block;

FIG. 48 is a section along line F—F of FIG. 47;

FIG. 49 is a top view of FIG. 47;

FIG. 50 illustrates three successive frames with lateral blocks of the embodiment of FIG. 47 when lashed together closely in the conveying direction;

FIG. 51 shows the safety shaft in the lateral blocks of FIG. 47;

DETAILED DESCRIPTION OF THE PREFERRED EMBODIMENTS

Figure 1:
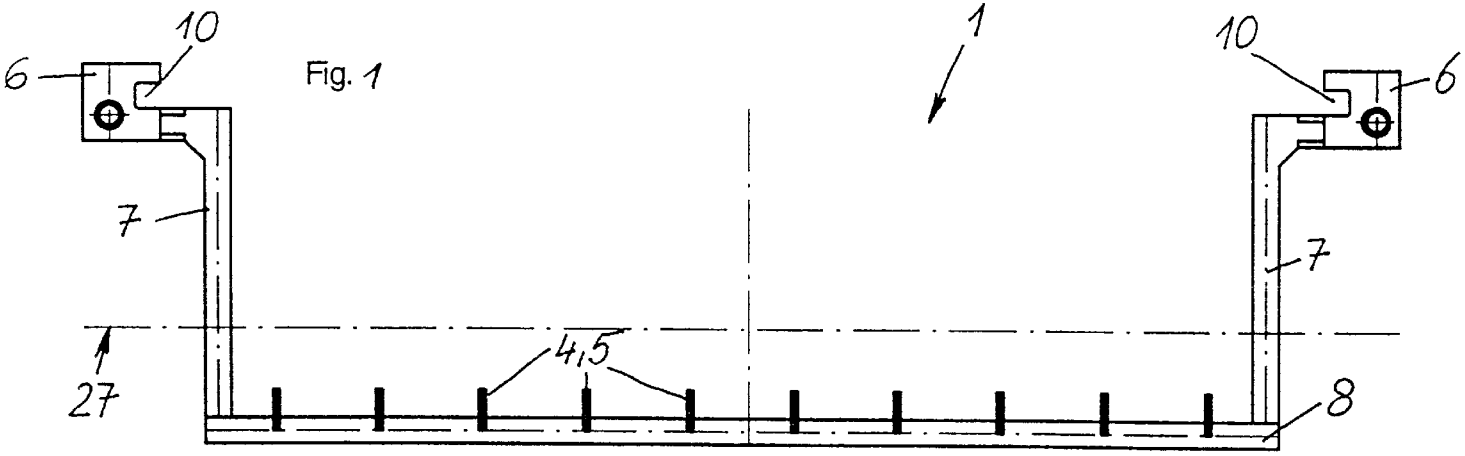
FIG. 1 is a side elevational view of one embodiment of the frame.

Referring to FIG. 1, which shows the simplest embodiment, frame 1 comprises two lateral cuboid blocks 6, two lateral braces 7 mounted on the lateral blocks and oriented vertically downwardly in their initial position, transverse shaft 8 connecting free ends of the lateral braces remote from the lateral blocks, and hooks 4, 5 for hanging the structural parts, the hooks being affixed to the transverse shaft and spaced from each other in a transverse direction. As shown, for example, in FIGS. 6, 10 and 12, successive frames 1 in the conveying direction are so close to each other that structural parts 2, 3 hanging on hooks 4, 5 are locked in position by transverse shafts 8 of the successive frames.

Phantom line 27 indicates the level of a finishing bath through which frame 1 is pulled in a conveying direction. This embodiment is quite useful for light-weight structural parts since such a frame requires little stability.

Figure 2:
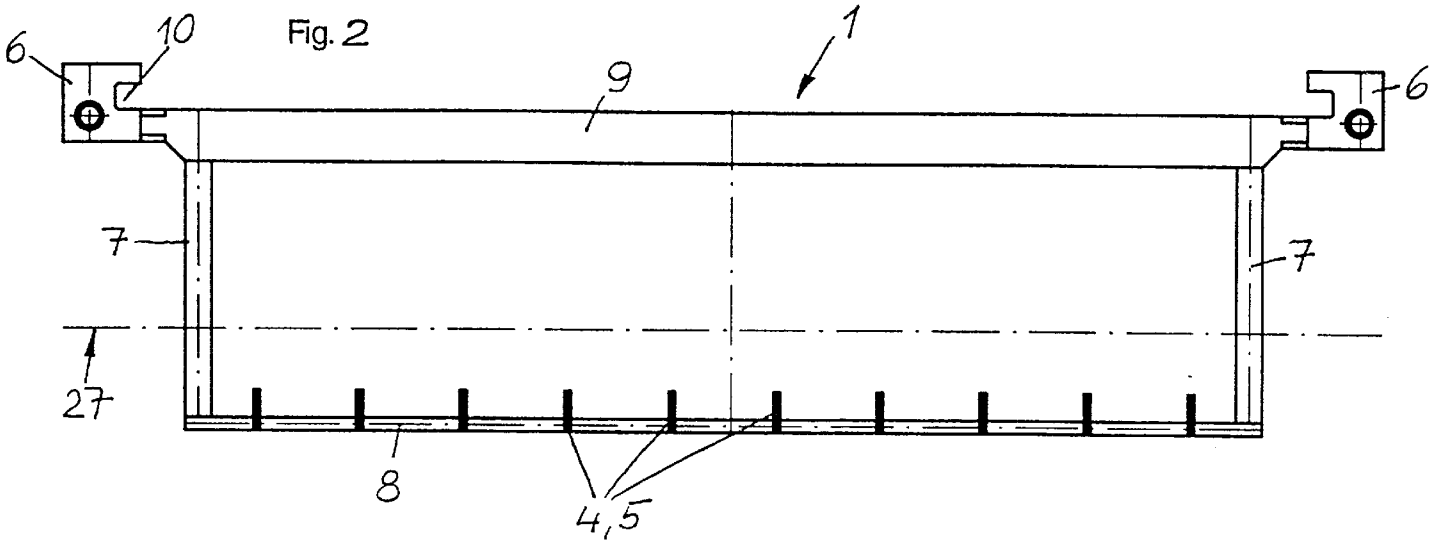
FIG. 2 is a like view showing another embodiment.

The stability of frame 1 is substantially enhanced in the embodiment of FIG. 2, in which crosshead 9 connects lateral blocks 6 to each other. Lateral braces 7 are affixed to the crosshead. Frame 1 may be made even more stable according to the embodiment shown in FIGS. 3 and 4 by braces 11 extending between hooks 4, 5 from transverse shaft 8 to crosshead 9.

Figures 3, 4, 5, 6:
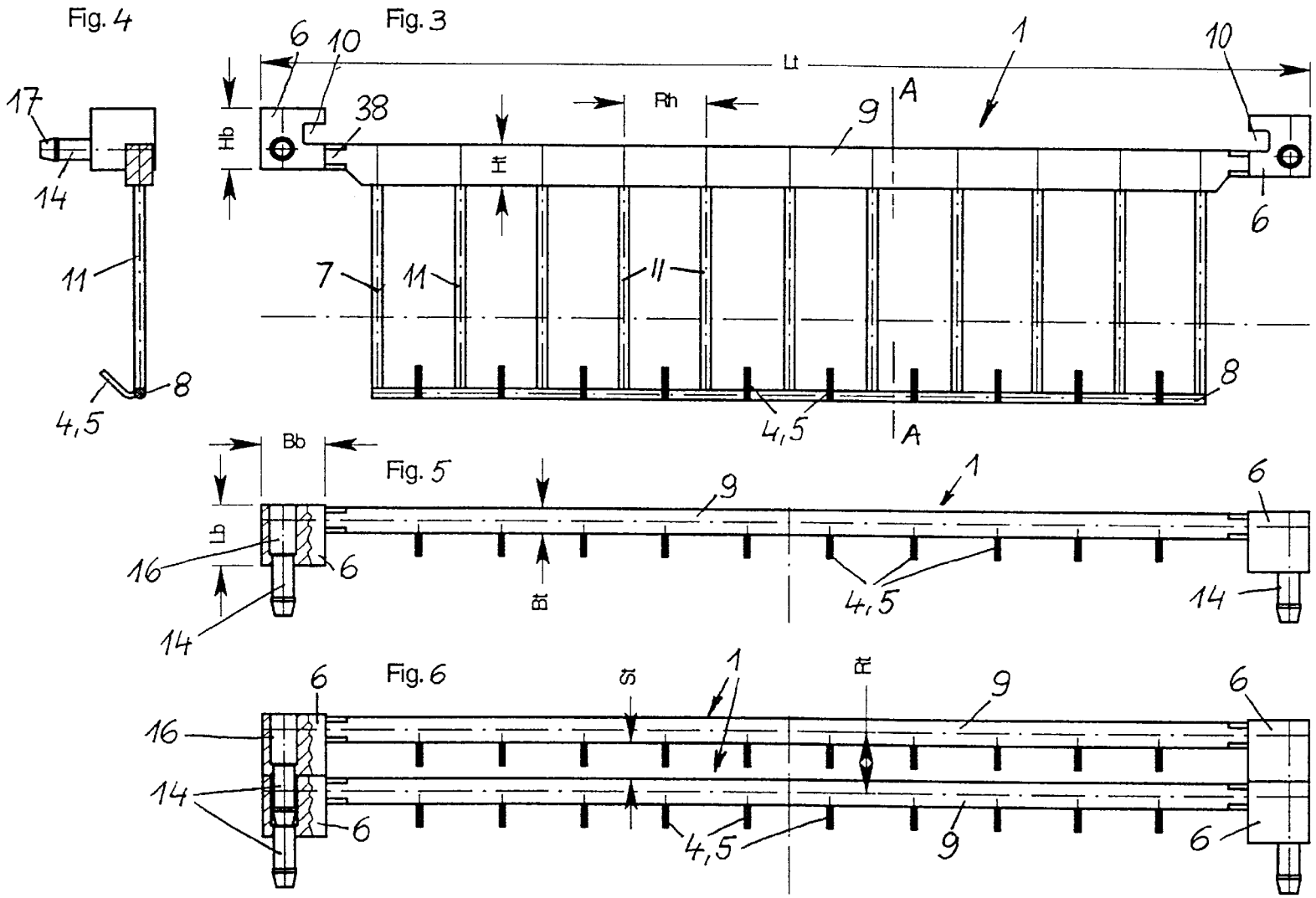
FIG. 3 is a like view showing a third embodiment.
FIG. 4 is a section along line A—A of FIG. 3.
FIG. 5 is a top view of the frame of FIG. 3.
FIG. 6 is a like view showing two successive ones of the frames of FIG. 3.

As shown in FIGS. 4–6 and in greater detail in FIGS. 16–19, successive frames 1 may be detachably lashed to each other in the conveying direction. To center the successive frames relative to each other, blocks 6 have pins 14 extending in, or opposite, the conveying direction and bores 16, the pins of one of the lateral blocks fitting into the bores of the lateral blocks of the successive frame whereby the frames are centered relative to each other. Pins 14 have a cylindrical portion, a conical free end 17 and a shoulder 18 between the cylindrical portion and the conical free end.

Lateral blocks 6 have journals 38 holding crosshead 9 for rotation about a longitudinal axis of the crosshead. The crosshead may be tubular or a solid shaft. The total length Lt of frame 1 (see FIG. 3) may be, for example, 800, 1200 or 2400 mm. The distance between braces 11 is designated Rq, the height of crosshead 9 is designated Ht, its width as Bt, the width of lateral block 6 as B, its length as Lb and its height as Hb. As shown in FIG. 6, Rt designates the distance between successive frames 1 when they are conveyed as close as possible to each other, leaving a gap St between the frames for inserting a wiper for removing bath liquid from the structural parts.

Figure 7:
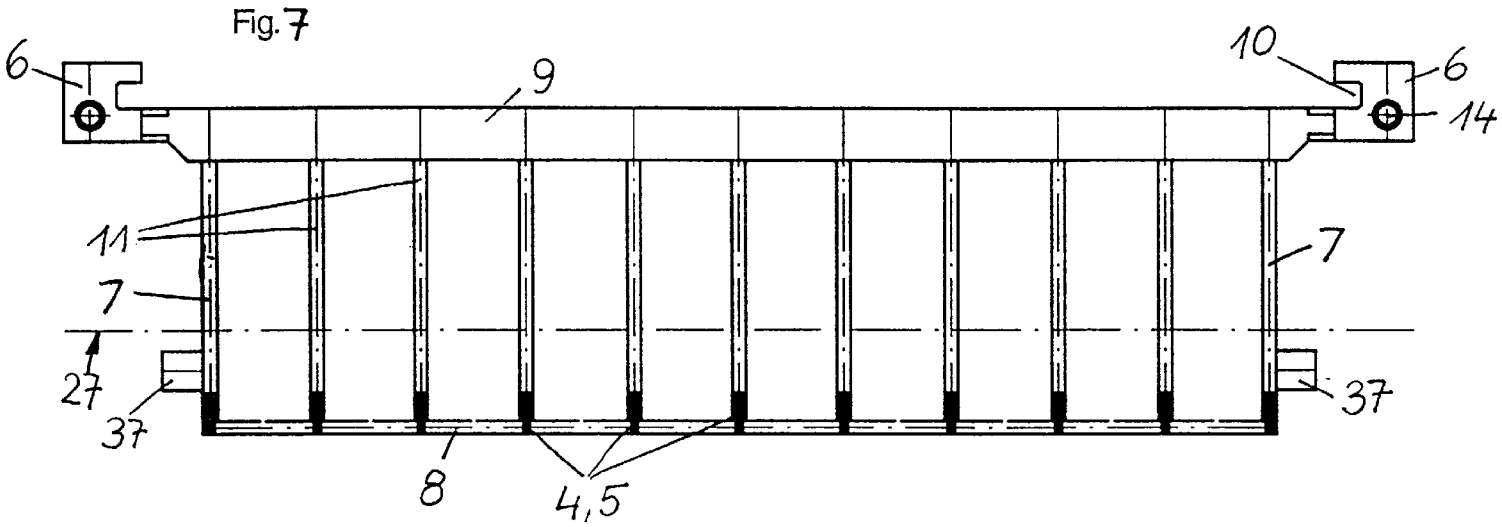
FIG. 7 is a side elevational view of yet another embodiment of the frame.

In the embodiment illustrated in FIG. 7, lateral braces 7 have outwardly projecting cam shafts 37, which may be located below or above bath level 27 and engage cam tracks for adjusting the rotational angle of the crosshead. The lateral braces as well as braces 11 extend from transverse shaft 8 to crosshead 9, and hooks 4, 5 are arranged at ends of the braces adjacent the transverse shaft. This embodiment is very stable and no torque is transmitted to transverse shaft 8.

Figure 8:
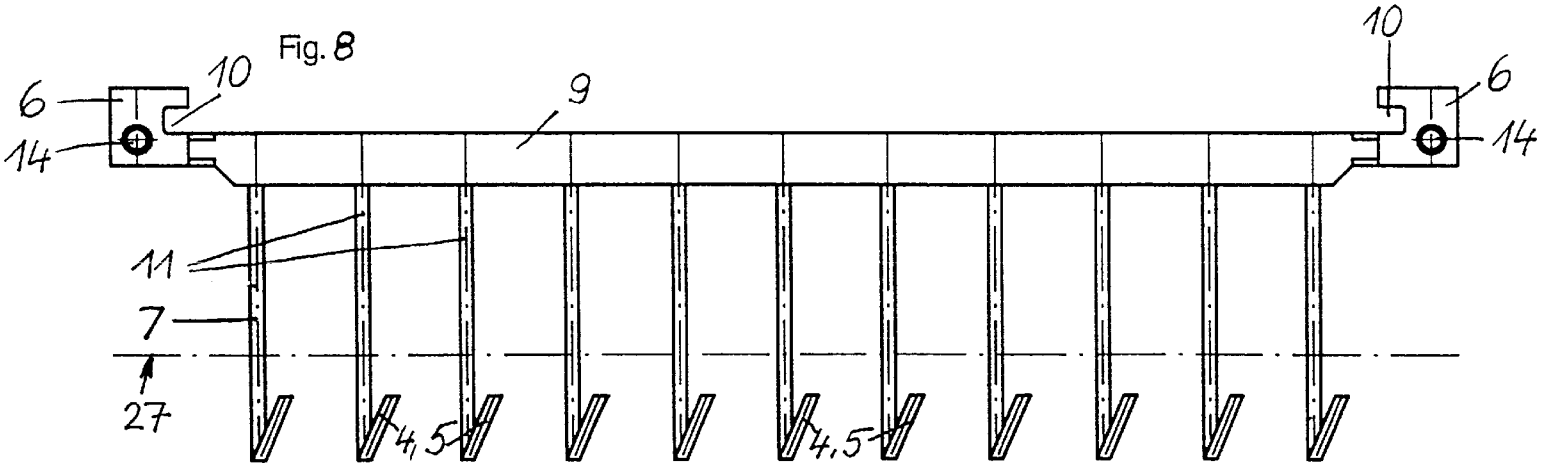
FIG. 8 is a like view of still another embodiment.

In the embodiment of FIG. 8, hooks 4, 5 are arranged at the free ends of braces 11 and there is no transverse shaft 8.

Figure 10:
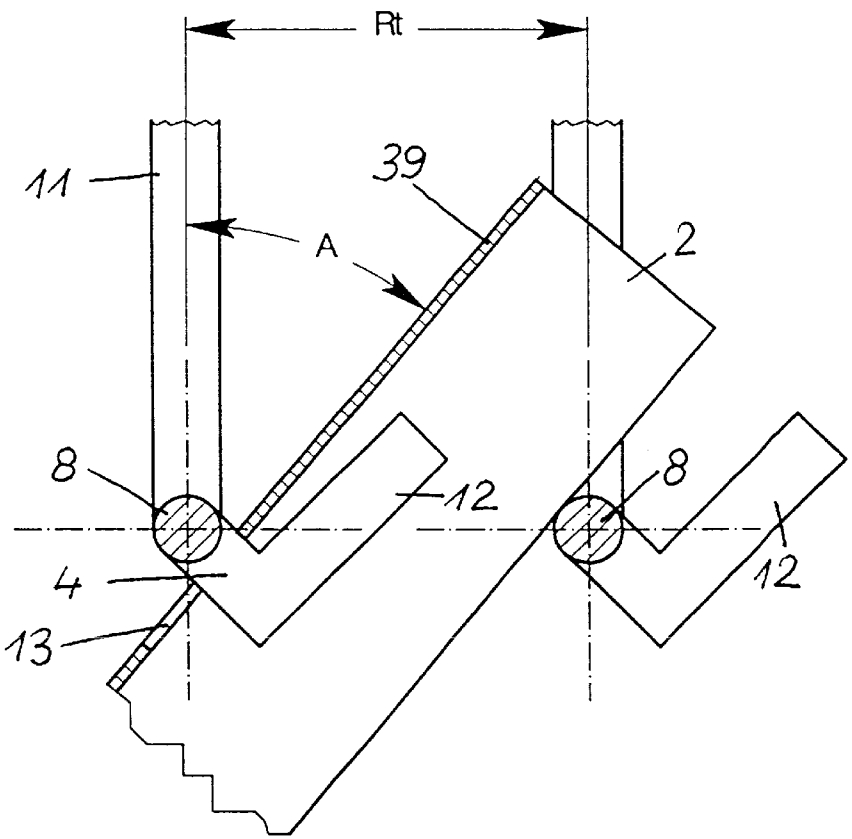
FIG. 10 shows this hanging thin-walled structural part locked in position by the transverse shaft of the adjacent frame when the two successive frames are close together in the conveying direction.
Figure 9:
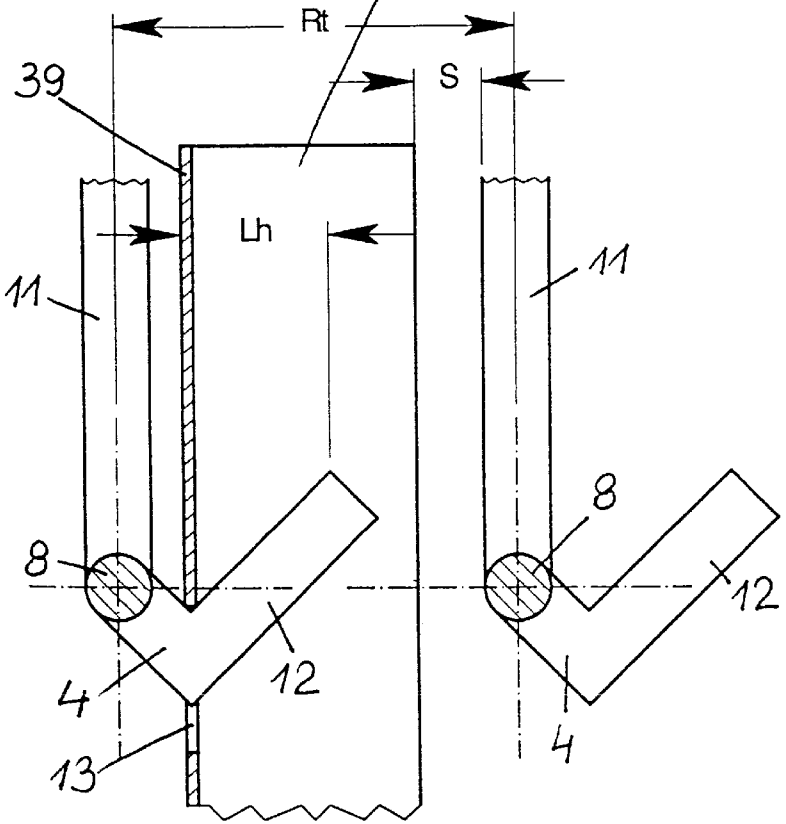
FIG. 9 is a fragmentary end view of two successive frames, showing a thin-walled structural part of a U-shaped cross section hanging by its rear wall on a hook.

FIGS. 9 and 10 show hooks 4 having a leg 12 projecting from a lower vertex and transverse shafts 8 are arranged so close to the lower vertex of the hooks in the conveying direction that the transverse shafts prevent the hanging structural parts 2 from falling off the hooks. The illustrated structural part 2 is U-shaped and its rear wall 39 has a hole 13 receiving hook 4 so that the structural part hangs on the hook. Braces 11 of two successive frames are offset from each other and distance Rt between the two frames is selected in relation to the length of the legs of U-shaped structural part 2. Distance Rh between hooks 4, 5 depends of the width of rear wall 39 of the structural parts, allowing for some play between the parts. This arrangement enables the structural parts to swing in either direction about an angle A. This embodiment is useful for hanging structural parts having an open or closed profile but it cannot be used for flat structural parts. If hook leg 12 extends substantially horizontally, solid structural parts may be hung. Hole 13 in the rear wall of the structural part is low and, as is shown in FIG. 10, when successive frame are close together during conveyance, structural part 2 is locked in position by transverse shafts 8 of the successive frames.

Figure 12:
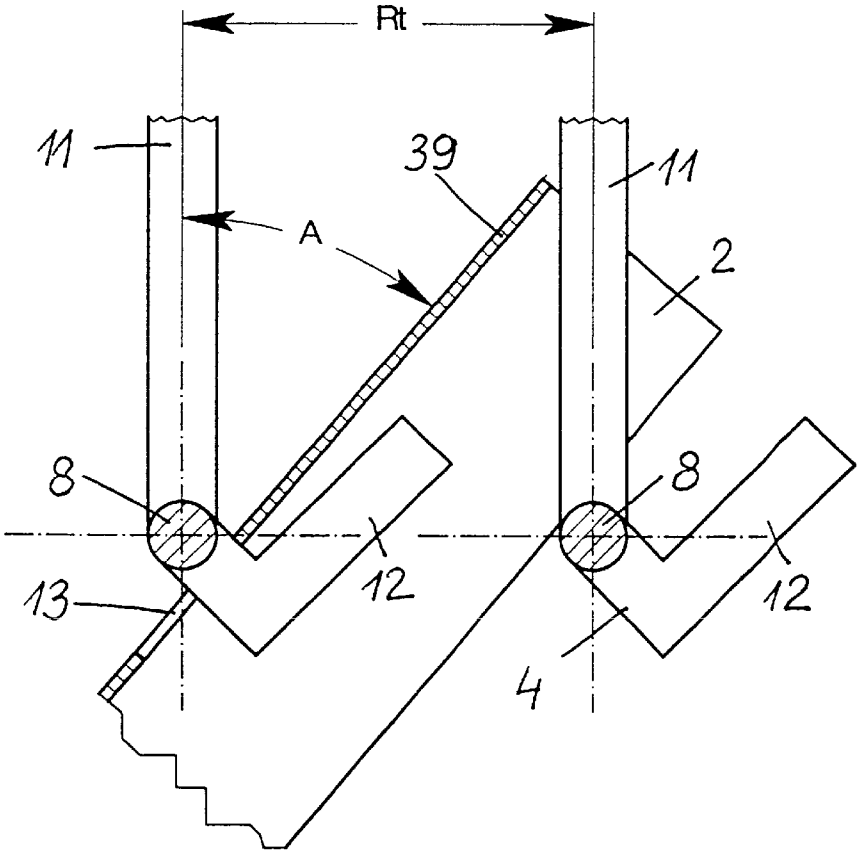
FIGS. 11 and 12 are similar to FIGS. 9 and 10, showing a directly supported hook and the conveyance of structural parts being open at a side facing the adjacent frame so that the part may swing through the plane of the adjacent frame.
Figure 11:
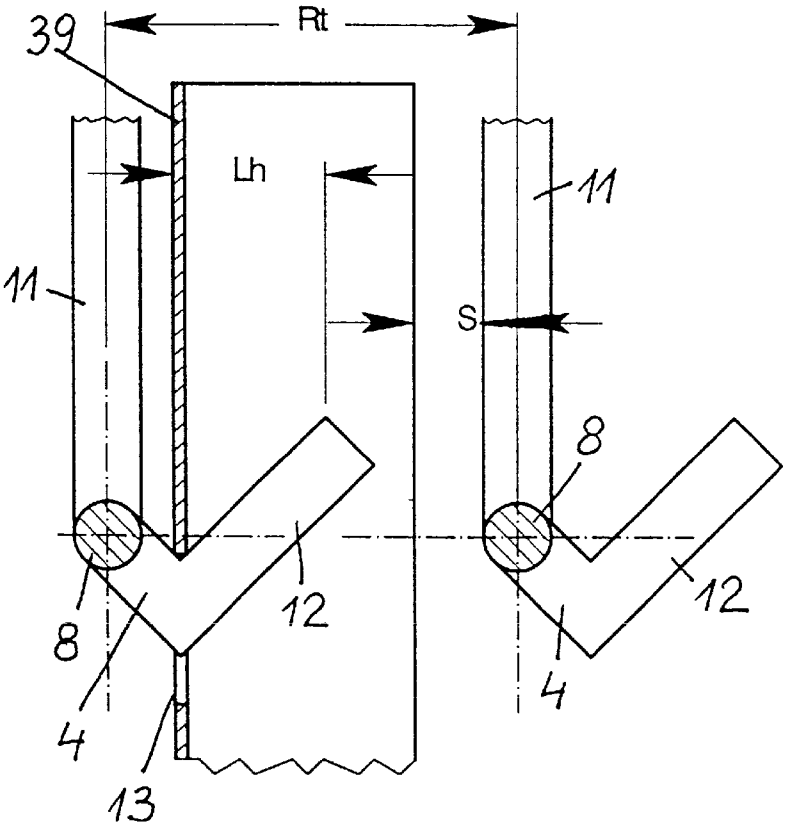

FIGS. 11 and 12 differ from the embodiment described in FIGS. 9 and 10 only in that braces 11 of successive frames are in alignment with each other so that structural part is able to swing about angle A only in the illustrated direction. This embodiment can be used only with structural parts having an open profile, such as U-shaped or angular parts, and the like. In the embodiments shown in FIGS. 9–12, distance S between hanging structural part 2 and the next frame must be smaller than distance Lh between the lower vertex of hook 4 and its free end.

Figure 13:
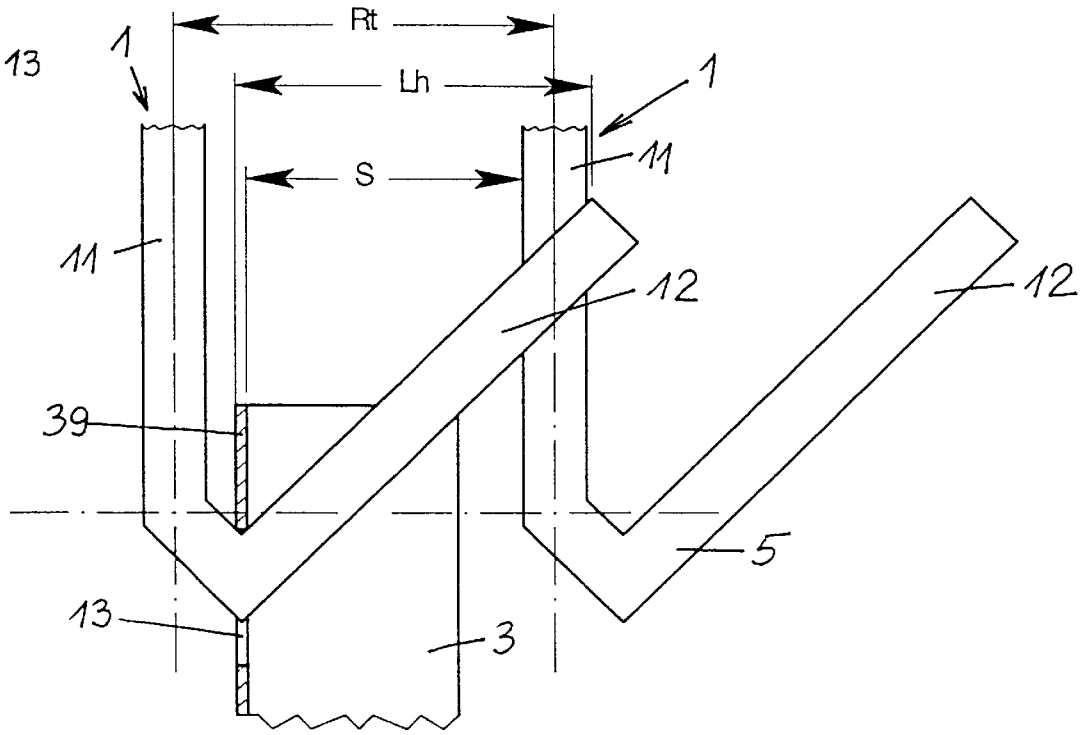
FIG. 13 is a like view showing a hook having a leg projecting from a lower vertex and long enough to intersect the adjacent frame.
Figure 14:
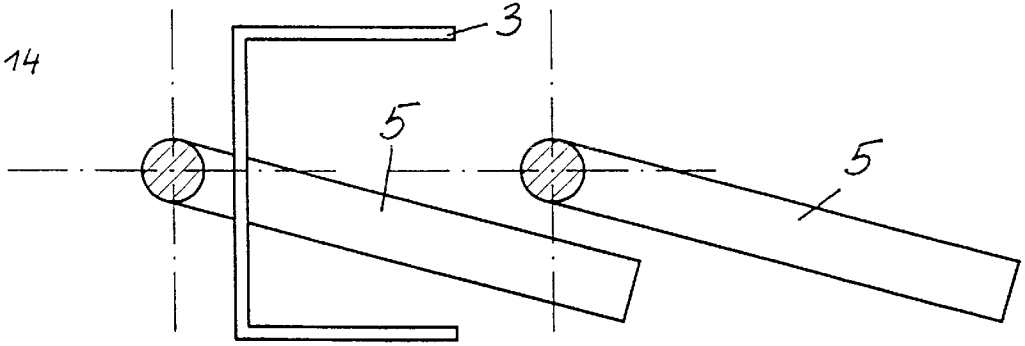
FIG. 14 is a top view of FIG. 13.

FIGS. 13 and 14 illustrate the hooks of the embodiment shown in FIG. 8. Hooks 5 have a leg 12 projecting from a lower vertex that is so long that it intersects a successive frame in the conveying direction to prevent the hanging structural parts from falling off the hooks. Such hooks may be useful for thin-walled, U-shaped structural parts 3 which are hung on hooks 5 by holes 13 located close to the upper ends of rear walls 39 of the structural parts. In this embodiment, the structural parts may swing forwardly and, more restricted, backwardly. Flat structural parts may also be hung on such hooks. The hooks of successive frames are laterally adjacent each other, as best shown in FIG. 14, so that hung structural parts 3 are locked in position and prevented from falling off their hooks.

Hooks 4, 5 having a lower vertex may be freely movably attached to transverse shaft 8 near the lower vertex.

Figure 18:
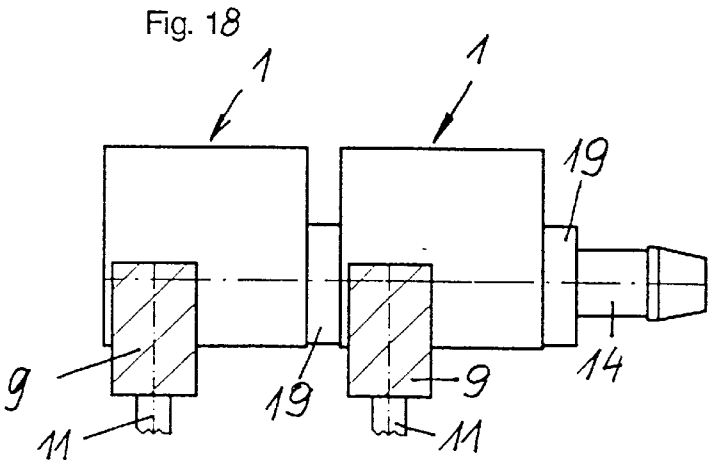
FIG. 18 is a view like that of FIG. 17 to show two detachably lashed together frames.
Figure 19:
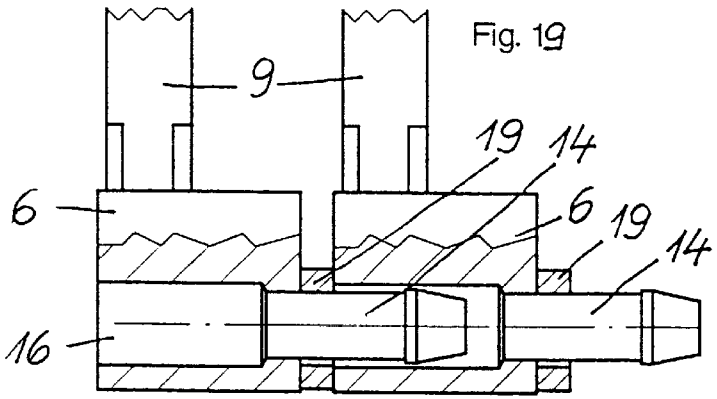
FIG. 19 is a view like that of FIG. 18 to show the connecting pins detachably lashing together two frames.
Figure 16:
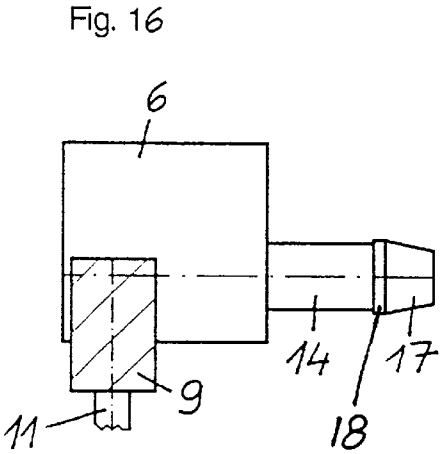
FIG. 16 is a top view of FIG. 15, partly in section.
Figure 17:
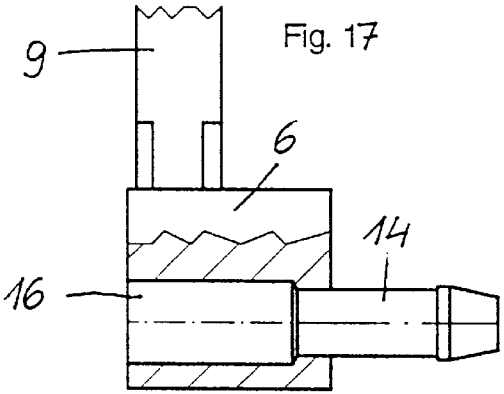
FIG. 17 shows the lateral block in partial section to illustrate the connecting pin.
Figure 15:
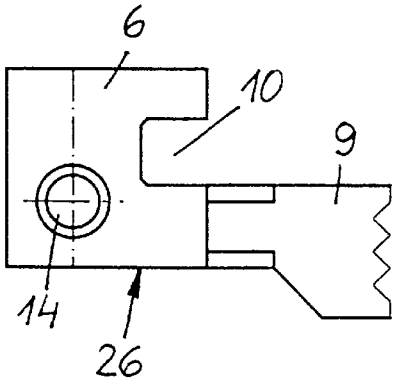
FIG. 15 is an enlarged side view of the lateral block of the frames of FIGS. 2–9.
Figure 24:
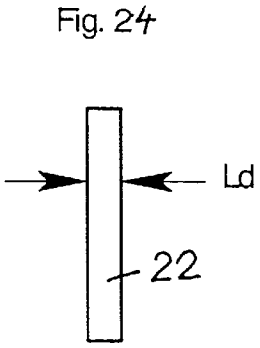
FIGS. 23 and 24 respectively show a spacing disc in top and side views.
Figure 23:
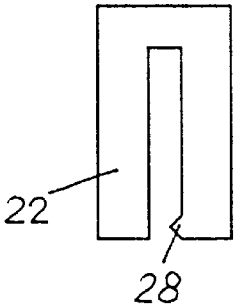

FIGS. 15 to 19 more clearly illustrate lateral block 6 having pin 14 extending in, or opposite, the conveying direction and bore 16, the pins of one of the lateral blocks fitting into the bores of the lateral blocks of the successive frame whereby the frames are centered relative to each other (see FIG. 19). Pins 14 have a cylindrical portion, a conical free end 17 and a shoulder 18 between the cylindrical portion and the conical free end. As shown in FIGS. 18 and 19, spacing sleeves 19 are detachably snapped onto pins 14 to distance successive frames from each other. The spacing discs may be U- or ring-shaped. When successive frames are plugged together by pins 14, the pins constitute torque bearings preventing the frames from rotating. The lateral blocks have wide lower faces 26 constituting bearings for receiving conveyor chains.

Figure 21:
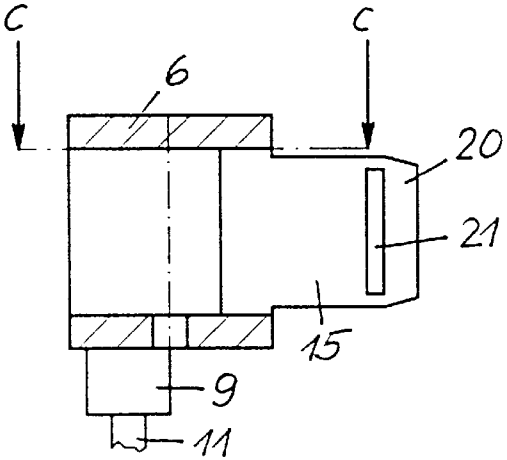
FIG. 21 is a section along line B—B of FIG. 20.
Figure 22:
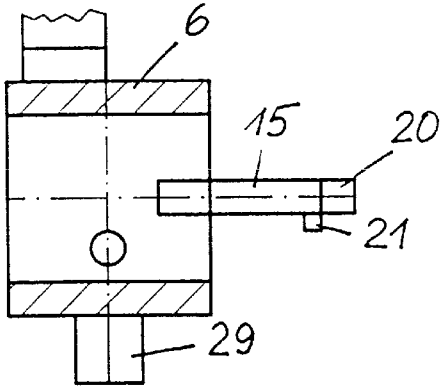
FIG. 22 is a section along line C—C of FIG. 21.
Figure 20:
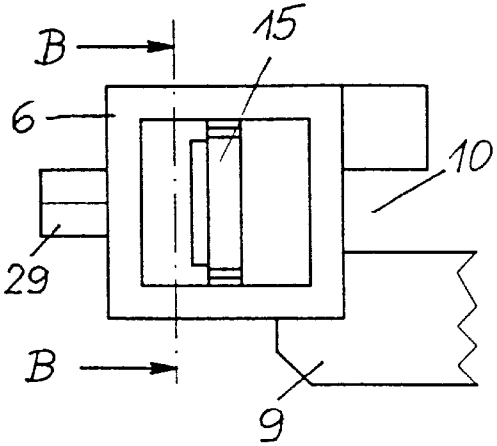
FIG. 20 illustrates another embodiment of a lateral side block.

In the embodiment shown in FIGS. 20 to 22, lateral block 6 has a rectangular cross section, and a narrow, substantially rectangular peg 15 of sheet metal is affixed to the block. Safety ledge 21 projects from end 20 of peg 15. U-shaped spacing disc 22 having a thickness Ld may be clamped on peg 15. Clamping lug 28 at an end of one of the legs of the U-shaped clamping disc securely holds the disc on the peg. Stub shaft 29 projects outwardly from lateral block 6 to enable crosshead 9 affixed to the block to be rotated about its longitudinal axis.

Figure 26:
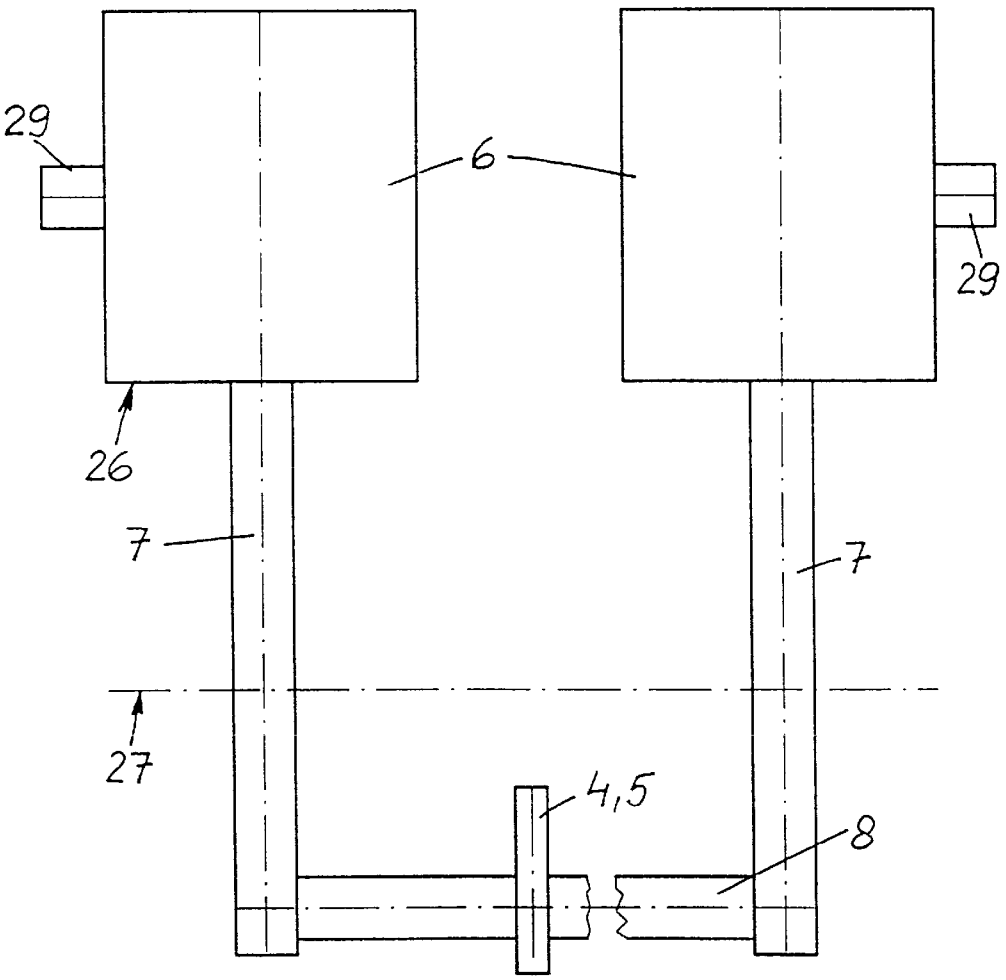
FIG. 26 is a side elevational view of a frame incorporating the embodiment of FIG. 25.
Figure 25:
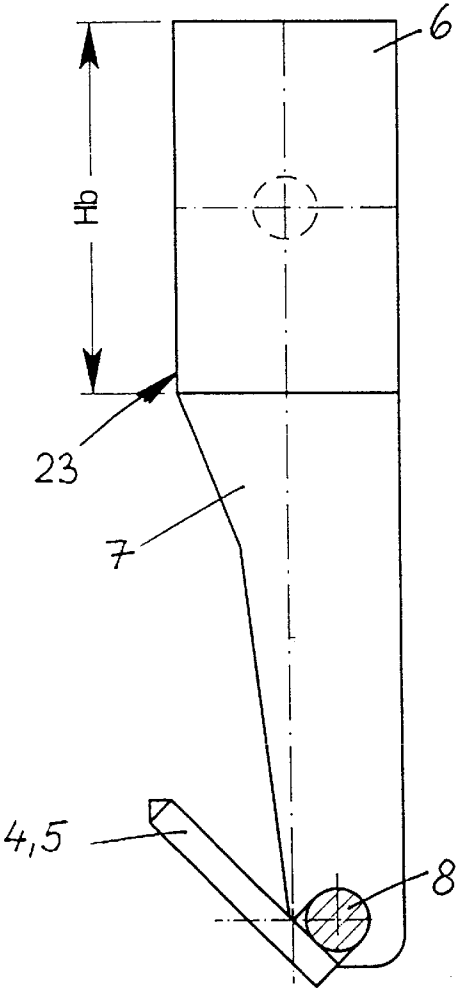
FIG. 25 illustrates another embodiment of the side block, the lateral brace and the hook.
Figure 28:
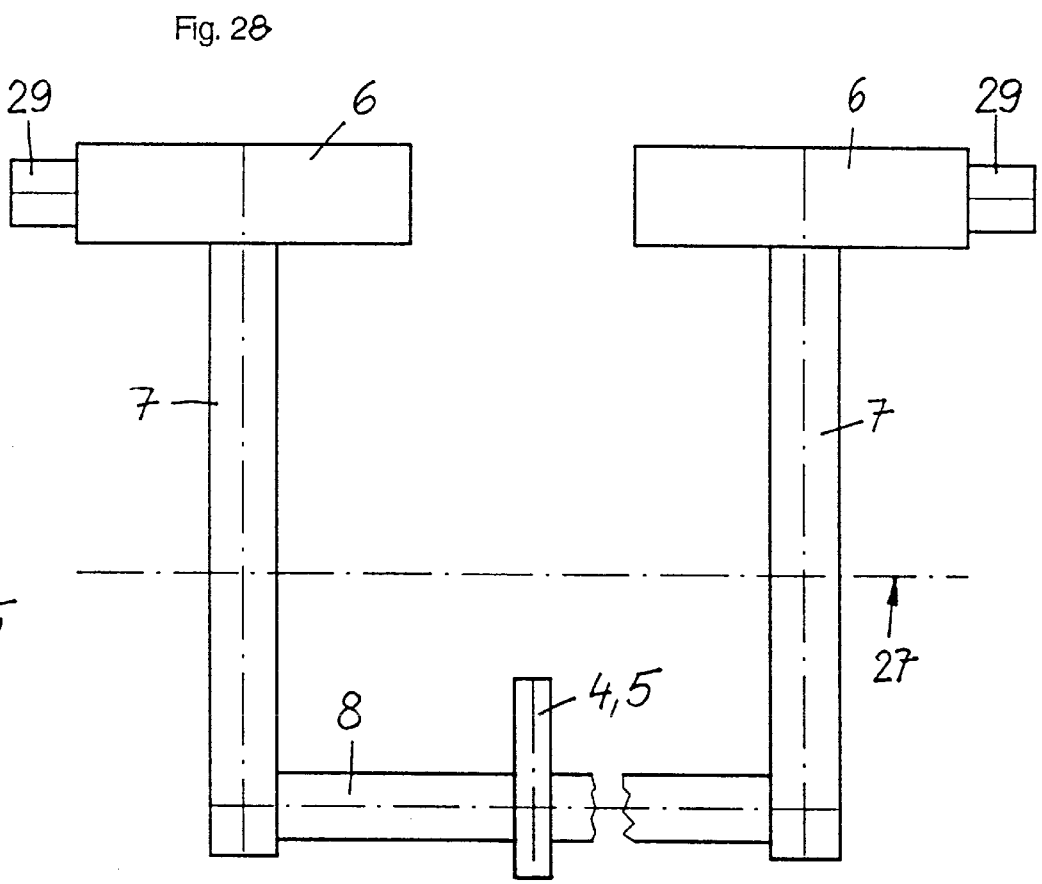
FIG. 28 is a side elevational view of a frame incorporating the embodiment of FIG. 27.
Figure 27:
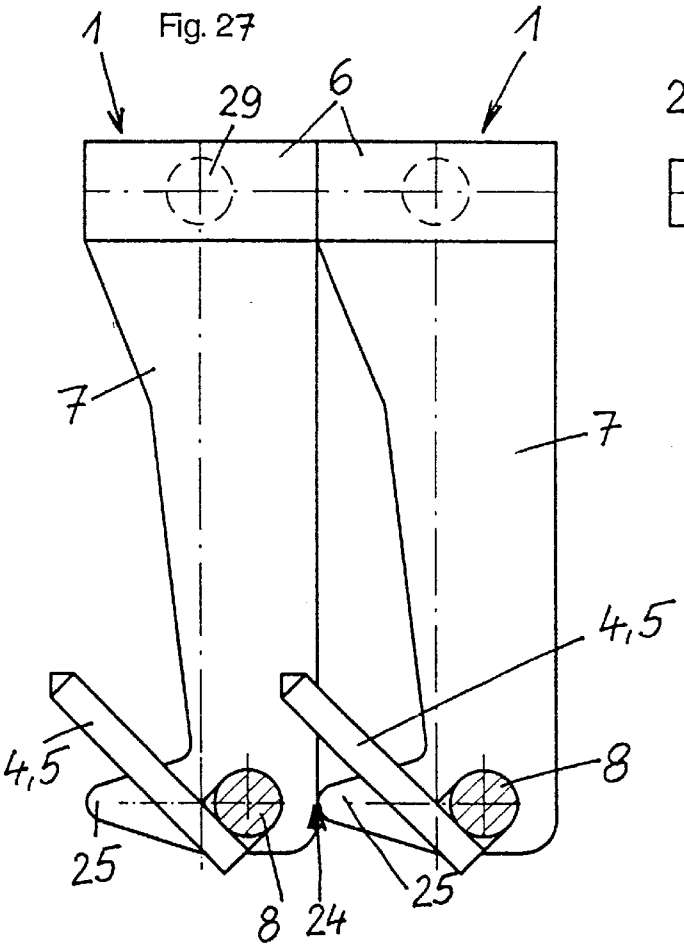
FIG. 27 illustrates a modification of the embodiment of FIG. 25, in connection with two adjacent frames.

In the embodiment of FIGS. 25 and 26, rectangular lateral block 6 is elongated, having a height Hb exceeding its width and providing torque bearing 23. Another torque bearing 24 is provided by noses 25 projecting from the free ends of lateral braces 7 towards successive frames, as shown in FIGS. 27 and 28. In this embodiment, blocks 6 have a relatively small height.

Figure 29:
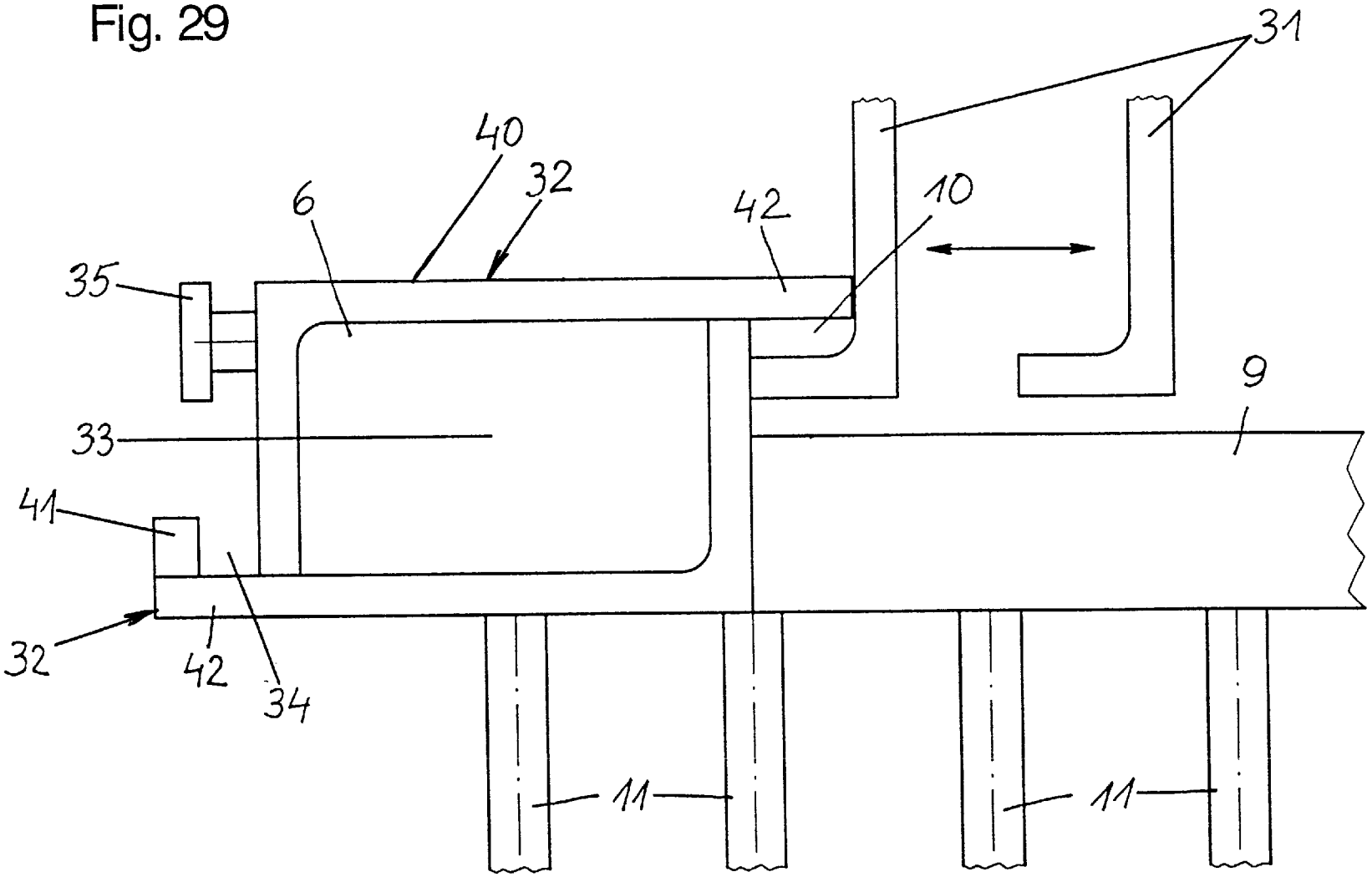
FIG. 29 is an enlarged view showing yet another embodiment of the lateral block.

Lateral block 6 shown in FIG. 29 is comprised of two L-shaped carriers 32 assembled to define a pocket 33 therebetween. One of the L-shaped carriers provides a guide track 34 at an outside of the lateral block, and a shaft with a collar 35 is attached to the other L-shaped carrier above the guide track 34. The two like L-shaped carrier elements 32 are affixed to each other to form a rectangle, horizontal legs 42 of the carrier elements projecting beyond the rectangle. The shoulder formed by the projecting portion of the upper horizontal leg 42 defines groove 10 enabling tong 31 of a gripper element to be engaged. Shaft having a collar 35 projects laterally outwardly from block 6 to enable the frame to be rotated about the longitudinal axis of crosshead 9. No outwardly projecting shaft will be required if crosshead 9 is rotatably journaled in block 6. The end of the projecting portion of lower horizontal leg 42 carries ledge 41, creating a bearing 34 for cables, chains, wires or rods to latch together the first and last frames. Upper surface 40 of blocks 6 may be configurated in a customer specific manner, to accommodate bores, screw threads, eyelets, pockets and the like.

The closely spaced successive frames may be secured in position in the conveying direction by the gripping elements, by inserting, at the beginning and the end of the assembly of frames, empty frames with wider upper horizontal legs 42 which may be more securely clamped by gripping elements 31. If the clamping face of the projecting portion of leg 42 is serrated, this gripping effect will be further enhanced.

Figure 30:
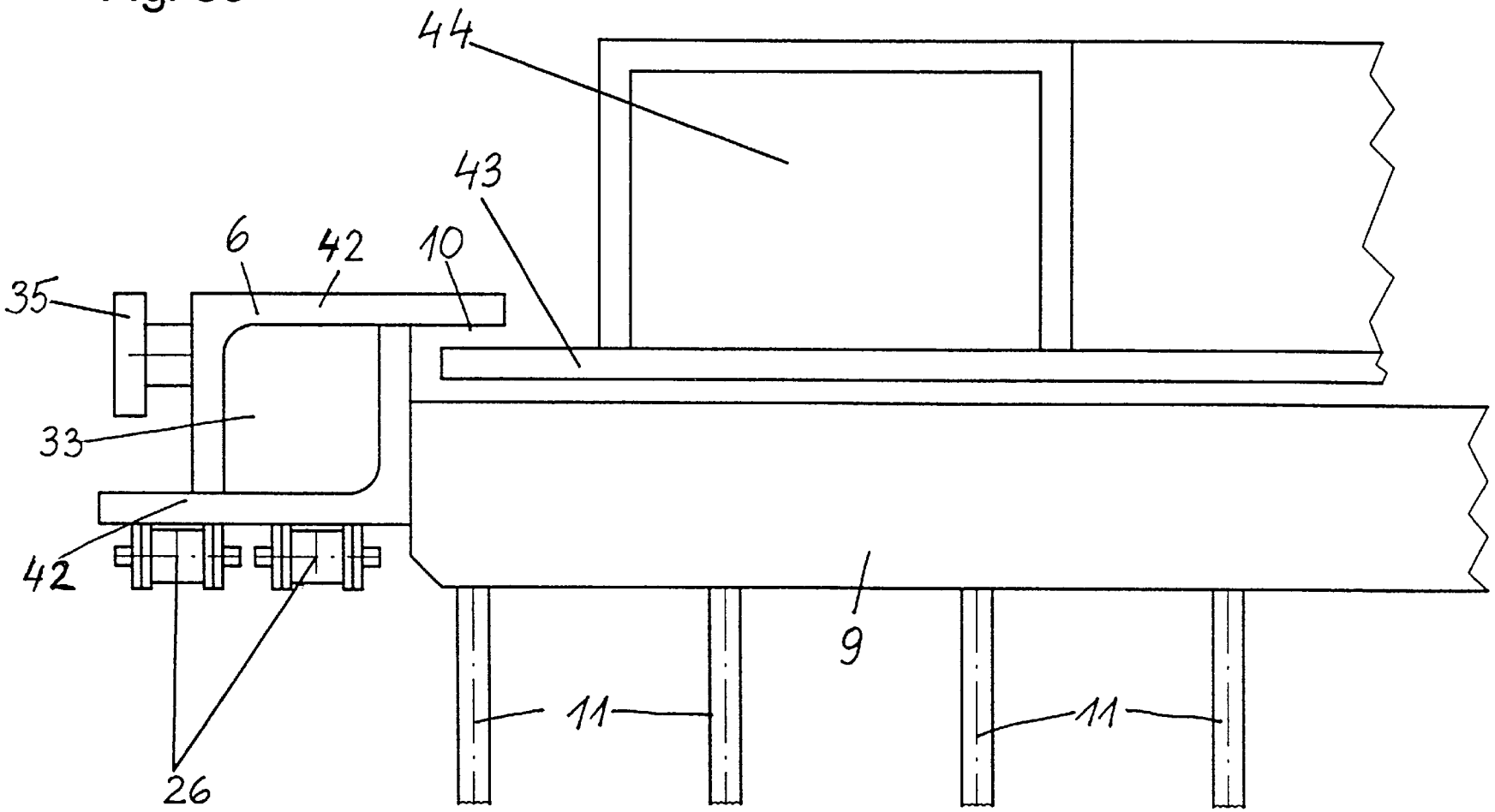
FIG. 30 shows the lateral block of FIG. 29, with an adapter plate for a high-lift.

FIG. 30 illustrates a modification of the embodiment of FIG. 29, in which adapter plate 43 for a high-life 44 is received in groove 10. A hydraulically operated gripping element may also be used. The surface of lower horizontal leg 42 constitutes a bearing for a two-track conveyor chain system 26.

Figures 31, 32, 33, 34, 35, 36, 37, 38:
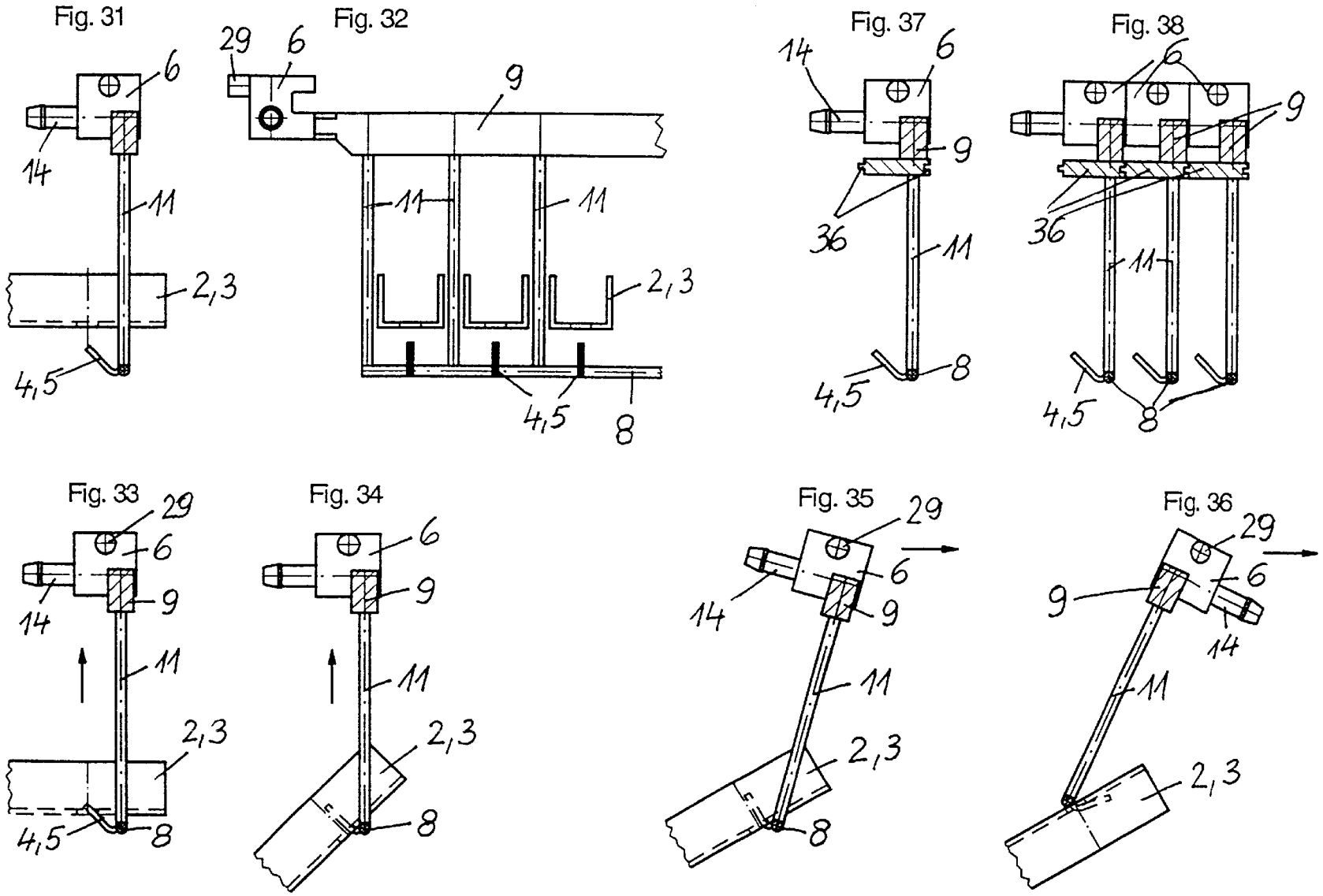
FIG. 31 is an end view of a frame, as it receives a structural part for hanging on a hook.
FIG. 32 is a fragmentary side elevation view of the frame of FIG. 31.
FIGS. 33 and 34 illustrate how a vertical movement of the frame of FIG. 31 enables the U-shaped structural parts to be hung and positioned on the hooks.
FIGS. 35 and 36 illustrate how the structural part is dragged along during conveyance in different positions of the hook.
FIGS. 37 and 38 show a frame and three successive frames, which are lashed together, with a self-sealing crosshead.
Figure 42:
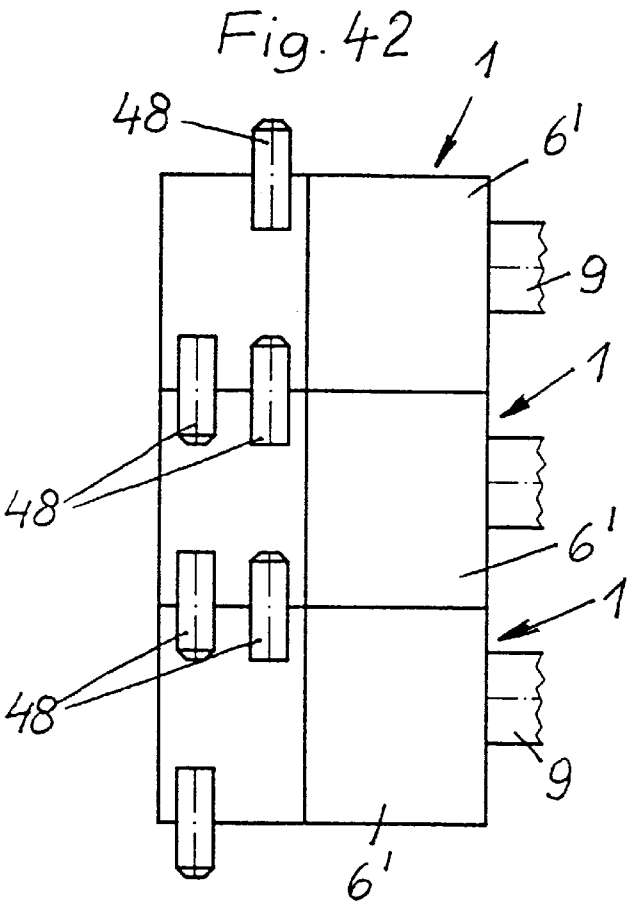
FIG. 42 illustrates three successive frames with lateral blocks of the embodiment of FIG. 39 when lashed together closely in the conveying direction.
Figure 39:
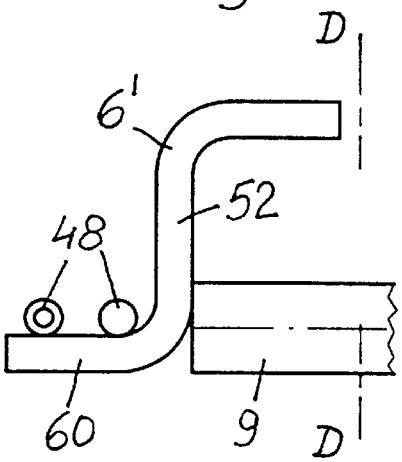
FIG. 39 shows a side elevational view of a further embodiment of the lateral block.
Figure 40:
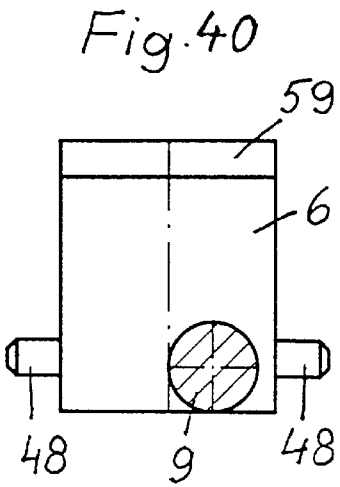
FIG. 40 is a section long line D—D of FIG. 39.
Figure 41:
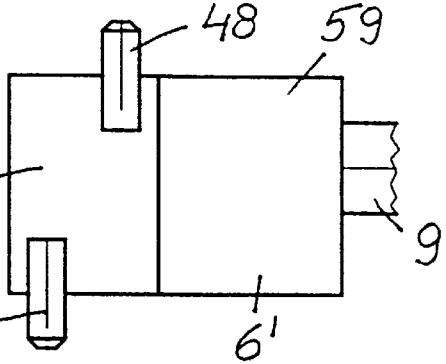
FIG. 41 is a top view of FIG. 39.
Figure 46:
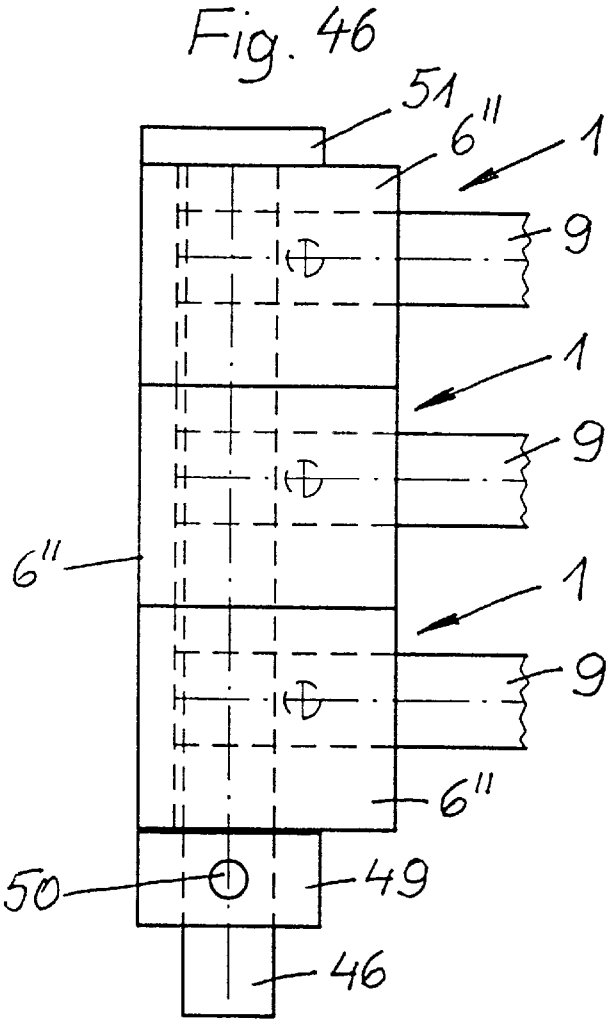
FIG. 46 illustrates three successive frames with lateral blocks of the embodiment of FIG. 43 when lashed together closely in the conveying direction.
Figure 43:
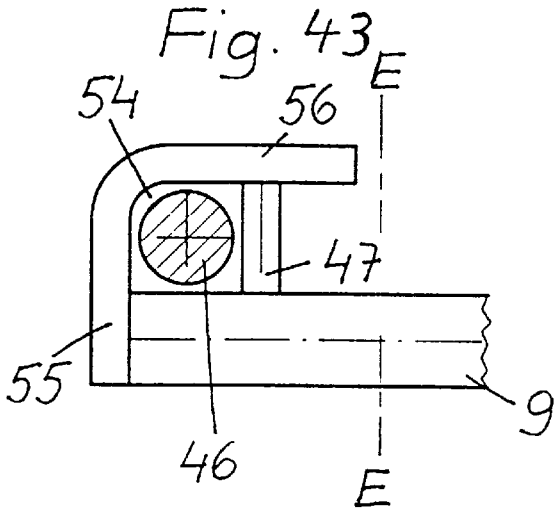
FIG. 43 shows a side elevationl view of still another embodiment of the lateral block.
Figure 45:
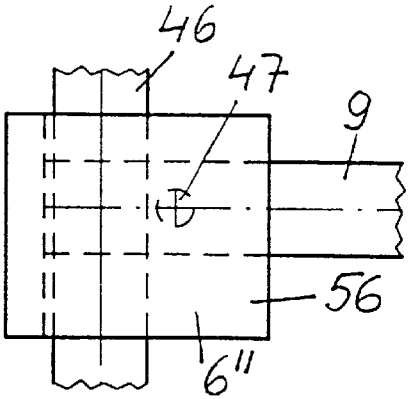
FIG. 45 is a top view of FIG. 43.
Figure 44:
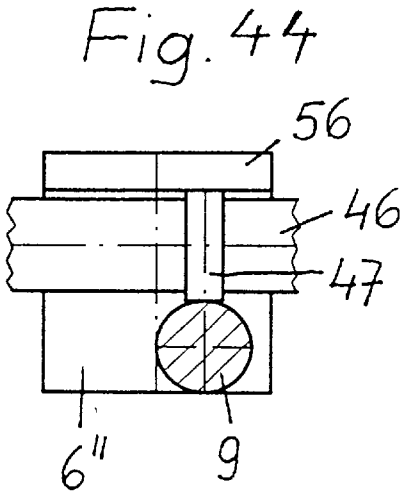
FIG. 44 is a section along line E—E of FIG. 43.
Figure 55:
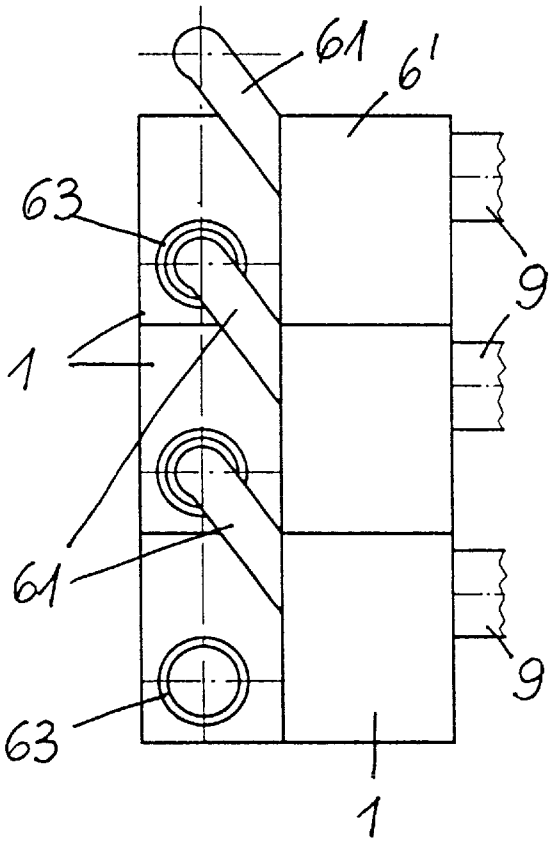
FIG. 55 illustrates three successive frames with lateral blocks of the embodiment of FIG. 52 when lashed together closely in the conveying direction.
Figure 52:
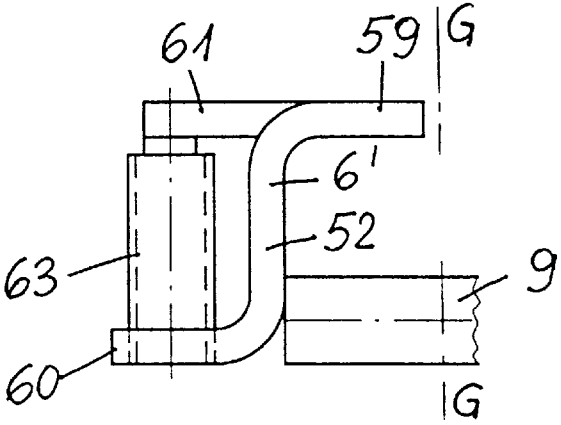
FIG. 52 shows a side elevational view of a further embodiment of the lateral block.
Figure 54:
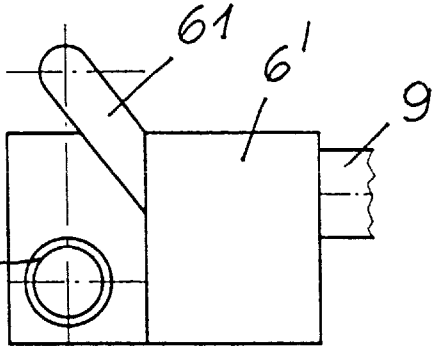
FIG. 54 is a top view of FIG. 52.
Figure 53:
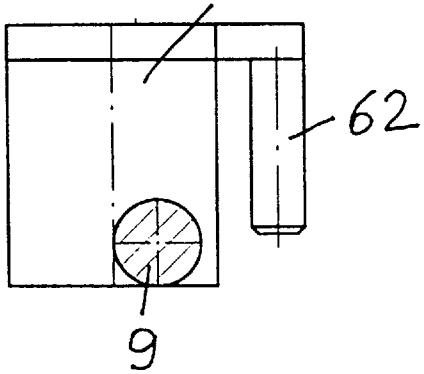
FIG. 53 is a section along line G—G of FIG. 52.

FIGS. 31 to 36 illustrate the advantages of handling U-shaped structural parts 2, 3 with the hooking system shown in FIGS. 3 to 5. As shown in FIGS. 31 and 32, the ends of hooks 4, 5 are positioned directly below the receiving holes in the rear walls of the U-shaped structural parts. FIGS. 33 and 34 show how the structural parts are hooked simply by raising the frames in the direction of the vertical arrows. FIGS. 35 and 36 illustrate how hanging structural parts 2, 3 are pulled along in the conveying direction while crosshead 9 is rotated about its longitudinal axis by laterally projecting stub shaft 29. The pivoting of the crosshead enables the structural parts to be held securely and to assume a horizontal position as they are pulled along in the conveying direction. At the end, the hooks may be moved out of the receiving holes in the structural parts to deposit the surface-finished parts.

If the U-shaped structural parts are to be stacked, it may be useful to arrange them with their rear wall 39 facing upwardly. For this purpose, crosshead 9 may be turned 180° about a vertical axis. Due to the geometry of structural parts 2, 3, they are always locked in position between crosshead 9 and hooks 4, 5 to prevent them from falling off the hooks. Pivoted crosshead 9 always keeps the hooks under tension, and the hooks may be turned out of the receiving holes only when the structural parts lie flat.

If desired, lateral blocks 6 may have inclined inner surfaces so that any bath liquid sprayed or condensed on the inner block surfaces may readily run off. The blocks may also have venting bores and the like.

FIGS. 36 and 37 show sealing elements 36 below crossheads 9 extending in the conveying direction. When successive frames are close to each other in the conveying direction (see FIG. 38), the sealing elements are interengaged to provide an effective seal for the assembly of frames. The sealing elements may be simple metal sheets, and they may be joined by interleafing lips, labyrinth joints and the like.

FIGS. 39 to 51 illustrate different embodiments of lateral blocks. They assure a good runoff of bath liquid, which is very advantageous when corrosive liquids are used.

In the embodiment shown in FIGS. 39–42, each lateral block 6' is comprised of a vertically extending leg 52 and upper and lower legs 59, 60 horizontally extending in opposite directions from the vertically extending leg in the conveying direction, and crosshead 9 is attached to the vertically extending leg of the lateral block. Furthermore, connecting pins 48 are arranged on lower horizontal leg 60, offset from each other in the conveying direction. When successive frames 1 are connected to each other during their conveyance (see FIG. 42), the connecting pins absorb the torque. The frames are lashed together by suitable means, such as rods, wires, chains, ropes and the like.

The embodiment shown in FIGS. 52–55 is similar but lateral block 6' comprises an arm 61 projecting laterally from the lateral block in a direction opposite to that of upper leg 59. A vertical socket pin 62 arranged at an end of arm 61, and the socket pin is engaged in a socket 63 affixed to a lateral block 6' in a successive frame (see FIG. 55).

Figures 56, 57, 58, 59:
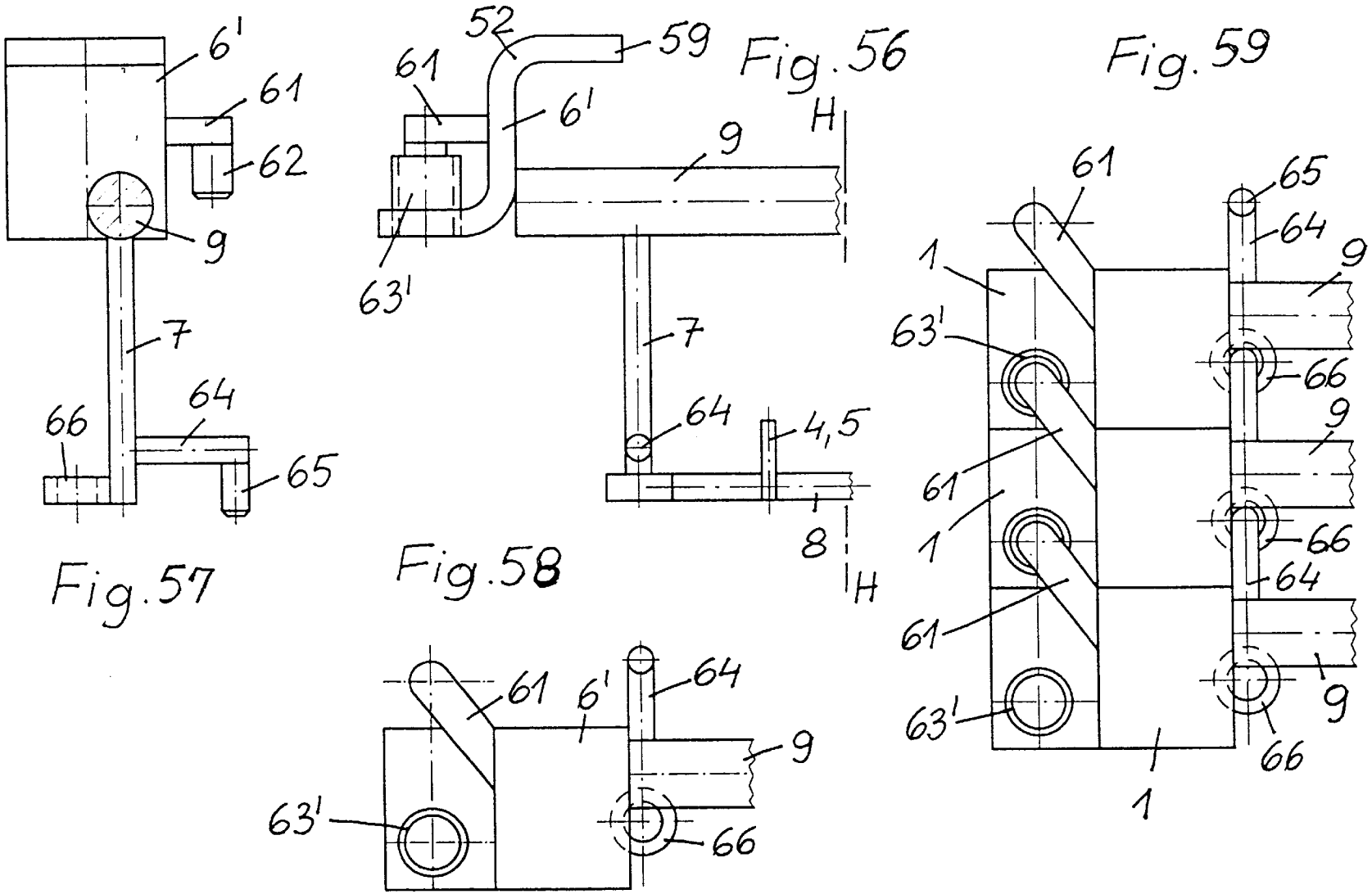
FIG. 56 shows a side elevational view of a further embodiment of the lateral block.
FIG. 57 is a section along line H—H of FIG. 56.
FIG. 58 is a top view of FIG. 56.
FIG. 59 illustrates three successive frames with lateral blocks of the embodiment of FIG. 56 when lashed together closely in the conveying direction.

A modification of lateral block 6' is shown in FIGS. 56–59, in which laterally projecting arms 61 extend from the center of vertical legs 52 so that socket pins 62 and sockets 63' are shorter. Furthermore, an arm 64 extends from lateral brace 7 near a lower end thereof and carries socket pin 65 while an oppositely directed arm 66 extending from the lower end of the lateral brace has a socket 66. When successive frames 1 are close to each other during conveyance, the socket pins 65 of one frame engage the sockets 66 of the adjacent frame (FIG. 59). In this embodiment, the frames are locked together at their lateral blocks as well as at the lower ends of the lateral braces near transverse shafts 8.

FIGS. 43–46 show a lateral block 6" comprised of a vertically extending leg 55 and a leg 56 horizontally extending from an upper end of the vertically extending leg. The crosshead 9 is attached to a lower end of the vertically extending leg of the lateral block. At a distance from vertically extending leg 55, a transverse pin 47 extends between horizontally extending leg 56 and the crosshead 9. The apparatus the legs 55, 56 of lateral block 6", transverse pin 47 and crosshead 9 define a passage 54, and a safety shaft 46 extends through the passage in the conveying direction (see FIG. 46). The safety shaft is secured by a head 51 at one end of the assembly of frames and an end disc 49 held in position by locking pin 50. This arrangement serves to absorb the torque during conveyance and, at the same time, lashes frames 1 together to prevent them from moving apart.

Lateral block 6''' shown in FIGS. 48–50 is comprised of a tube 57 extending in the conveying direction and a flat plate 58 of sheet metal extending horizontally and attached to the tube. Crosshead 9 is affixed to the tube of the lateral block. Safety shaft 46 extends through the tubes of the blocks of the successive frames 1. To assure proper runoff of bath liquid from lateral blocks 6''', the blocks may have runoff passages. Also, if a gripping element is used, tubular lateral blocks without the flat plate 58 may be used. FIG. 51 shows safety shaft 46 used in the embodiments of FIGS. 44–50.

What is claimed is:

1. An apparatus for positioning, handling and conveying structural parts in a conveying direction for surface finishing the structural parts, which comprises successively arranged frames, each frame comprising (a) two lateral blocks, (b) two lateral braces, (c) a transverse shaft connecting free ends of the lateral braces remote from the lateral blocks, (d) hooks for hanging the structural parts, the hooks being affixed to the transverse shaft and spaced from each other in a transverse direction, and (e) means for detachably lashing successive ones of the frames to each other in the conveying direction whereby the frames are so close to each other that the structural parts hanging on the hooks are locked in position by the transverse shafts of the successive frames.

2. The apparatus of claim 1, wherein the hooks have a leg projecting from a lower vertex and the transverse shafts are arranged so close to the lower vertex of the hooks in the conveying direction that the transverse shafts prevent the hanging structural parts from falling off the hooks.

3. The apparatus of claim 1, wherein the hooks have a leg projecting from a lower vertex, the leg being so long that it intersects a successive one of the frames in the conveying direction to prevent the hanging structural parts from falling off the hooks.

4. The apparatus of claim 1, further comprising a crosshead connecting the lateral blocks to each other, the lateral braces being affixed to the crosshead.

5. The apparatus of claim 4, wherein the lateral blocks have journals holding the crosshead for rotation about a longitudinal axis of the crosshead.

6. The apparatus of claim 5, wherein the lateral braces have cam shafts engaging cam tracks for adjusting the rotational angle of the crosshead.

7. The apparatus of claim 4, further comprising braces extending between the hooks from the transverse shaft to the crosshead.

8. The apparatus of claim 4, further comprising braces extending from the transverse shaft to the crosshead, the hooks being arranged at ends of the braces adjacent the transverse shaft.

9. The apparatus of claim 4, wherein each lateral block is comprised of a vertically extending leg and upper and lower legs horizontally extending in opposite directions from the vertically extending leg, and the crosshead is attached to the vertically extending legs of the lateral blocks.

10. The apparatus of claim 9, further comprising an arm projecting laterally from the lateral block in a direction opposite to that of the upper leg, a vertical socket pin arranged at an end of the arm, and the socket pin being engaged in a socket affixed to a respective one of the lateral blocks in a successive one of the frames.

11. The apparatus of claim 4, wherein each lateral block is comprised of a vertically extending leg and a leg horizontally extending the vertically extending leg, the crosshead is attached to the vertically extending legs of the lateral blocks, and further comprising a transverse pin extending between the horizontally extending leg and the crosshead.

12. The apparatus of claim 11, wherein the legs of the lateral block, the transverse pin and the crosshead define a passage, further comprising a safety shaft extending through the passage in the conveying direction.

13. The apparatus of claim 4, wherein each lateral block is comprised of a tube extending in the conveying direction and a flat plate extending horizontally and attached to the tube, the crosshead being affixed to the tubes of the lateral blocks.

14. The apparatus of claim 13, comprising a safety shaft extending through the tube.

15. The apparatus of claim 1, wherein the means for detachably lashing the successive frames to each other comprise pins on, and bores in, the lateral blocks, the pins of one of the lateral blocks fitting into the bores of the lateral blocks of the successive frame.

16. The apparatus of claim 15, wherein the pins have a cylindrical portion, a conical free end and a shoulder between the cylindrical portion and the conical free end.

17. The apparatus of claim 16, further comprising spacing sleeves detachably snapped onto the pins.

18. The apparatus of claim 16, wherein the pins are disc-shaped and carry a safety bead at their ends.

19. The apparatus of claim 18, further comprising a U-shaped spacing disc detachably mounted on the pins.

20. The apparatus of claim 1, further comprising torque bearing means for absorbing torque between the successive frames during conveyance.

21. The apparatus of claim 20, wherein the lateral braces have noses projecting from the free ends thereof towards successive frames and acting as torque bearings.

22. The apparatus of claim 1, wherein the lateral blocks have bearings for receiving conveyor chains.

23. The apparatus of claim 1, wherein the lateral blocks are comprised of two L-shaped carriers assembled to define a pocket therebetween.

24. The apparatus of claim 23, wherein one of the L-shaped carriers provides a guide track at an outside of the lateral block, and a shaft with a collar is attached to the other L-shaped carrier above the guide track.

25. The apparatus of claim 1, further comprising sealing elements extending in the conveying direction.

26. An apparatus for positioning, handling and conveying structural parts for a surface finishing of the parts, which comprises frames arranged successively in a conveying direction, hooks carried by the frames for hanging the structural parts, and means for detachably lashing successive ones of the frames to each other in the conveying direction whereby the frames are so close to each other that the structural parts hanging on the hooks are locked in position by the successive frames.

27. A method for positioning, handling and conveying structural parts for a surface finishing of the parts, which comprises conveying successively arranged frames in a conveying direction, hanging the structural parts on hooks carried by the frames, and detachably lashing successive ones of the frames to each other in the conveying direction whereby the frames are so close to each other that the structural parts hanging on the hooks are locked in position by the successive frames.

28. The method of claim 27, wherein the hooks have a lower vertex and the frames comprise transverse shafts close to the vertex of the hooks, the structural parts being locked in position by the transverse shafts of the successive frames.

* * * * *